US011635214B2

(12) United States Patent
Trammell et al.

(10) Patent No.: US 11,635,214 B2
(45) Date of Patent: Apr. 25, 2023

(54) BASE PAN FOR HVAC SYSTEM

(71) Applicant: Johnson Controls Technology Company, Auburn Hills, MI (US)

(72) Inventors: Curtis A. Trammell, Newcastle, OK (US); Anthony J. Reardon, Moore, OK (US); Hector I. Grajales Torres, Oklahoma City, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 144 days.

(21) Appl. No.: 16/742,696

(22) Filed: Jan. 14, 2020

(65) Prior Publication Data

US 2021/0190332 A1 Jun. 24, 2021

Related U.S. Application Data

(60) Provisional application No. 62/951,677, filed on Dec. 20, 2019.

(51) Int. Cl.

| | |
|---|---|
| ***F24F 1/36*** | (2011.01) |
| ***F24F 1/14*** | (2011.01) |
| ***F24F 13/22*** | (2006.01) |
| ***F24F 1/10*** | (2011.01) |
| ***F24F 13/30*** | (2006.01) |
| ***F24F 13/20*** | (2006.01) |
| ***F24F 11/30*** | (2018.01) |

(52) U.S. Cl.

CPC ..... *F24F 1/36* (2013.01); *F24F 1/14* (2013.01); *F24F 13/222* (2013.01); *F24F 1/10* (2013.01); *F24F 11/30* (2018.01); *F24F 13/20* (2013.01); *F24F 13/30* (2013.01)

(58) Field of Classification Search

CPC ..... F25D 21/14; F24F 1/36; F24F 1/10; F24F 13/222; F24F 13/20

See application file for complete search history.

(56) References Cited

U.S. PATENT DOCUMENTS

| | | | | |
|---|---|---|---|---|
| 4,513,586 | A * | 4/1985 | Jennings | F24F 1/10 248/678 |
| 10,126,013 | B2 * | 11/2018 | Yamamoto | F24F 1/0059 |
| 2019/0293307 | A1 | 9/2019 | Jones et al. | |

FOREIGN PATENT DOCUMENTS

| | | | |
|---|---|---|---|
| CN | 203364279 | U | 12/2013 |
| CN | 203823942 | U | 9/2014 |
| EP | 961908 | B1 | 5/2003 |
| EP | 2322868 | A2 | 5/2011 |
| JP | 2008175411 | A | 7/2008 |
| JP | 2009138950 | A | 6/2009 |
| WO | 2013122449 | A1 | 8/2013 |
| WO | 2017195335 | A1 | 11/2017 |
| WO | 2018011939 | A1 | 1/2018 |

* cited by examiner

*Primary Examiner* — Schyler S Sanks
(74) *Attorney, Agent, or Firm* — Fletcher Yoder, P.C.

(57) ABSTRACT

A heating, ventilation, and/or air conditioning (HVAC) unit includes an HVAC unit enclosure having a base pan. The base pan is sloped from an inner portion of the enclosure to an outer lateral edge of the base pan such that the base pan is configured to direct flow of liquid toward and over the outer lateral edge to flow off the base pan.

23 Claims, 10 Drawing Sheets

BASE PAN FOR HVAC SYSTEM

CROSS REFERENCE TO RELATED APPLICATIONS

This application claims priority from and the benefit of U.S. Provisional Application Ser. No. 62/951,677, entitled "BASE PAN FOR HVAC SYSTEM," filed Dec. 20, 2019, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. The HVAC system may have various enclosures or sections, such as an enclosure through which an air flow, such as an ambient air flow, may be directed. In some circumstances, liquid, such as outdoor precipitation, may accumulate within one of the enclosures. However, accumulation of liquid within the enclosure may not be desirable for operation of the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) unit includes an HVAC unit enclosure having a base pan. The base pan is sloped from an inner portion of the enclosure to an outer lateral edge of the base pan such that the base pan is configured to direct flow of liquid toward and over the outer lateral edge to flow off the base pan.

In one embodiment, a heating, ventilation, and/or air conditioning (HVAC) unit includes a condenser and a base pan positioned beneath the condenser. The base pan includes an outer lateral edge and an elevated surface relative to the outer lateral edge, a surface extending from the elevated surface to an outer lateral edge. Additionally, the base pan is configured to be positioned in an enclosure of the HVAC unit, and the base pan is downwardly sloped from the elevated surface to the outer lateral edge such that the base pan is configured to direct liquid away from the elevated surface to the outer lateral edge.

In one embodiment, a heating, ventilation, and/or air conditioning (HVAC) unit includes an enclosure and a base pan disposed within the enclosure. The base pan includes an outer lateral edge, a first panel sloped from an inner portion of the enclosure to the outer lateral edge, and a second panel sloped from the inner portion of the enclosure to the outer lateral edge. The first panel and the second panel are configured to direct liquid from the inner portion toward the outer lateral edge.

DRAWINGS

Various aspects of this disclosure may be better understood upon reading the following detailed description and upon reference to the drawings in which.

DETAILED DESCRIPTION

Figure 1:
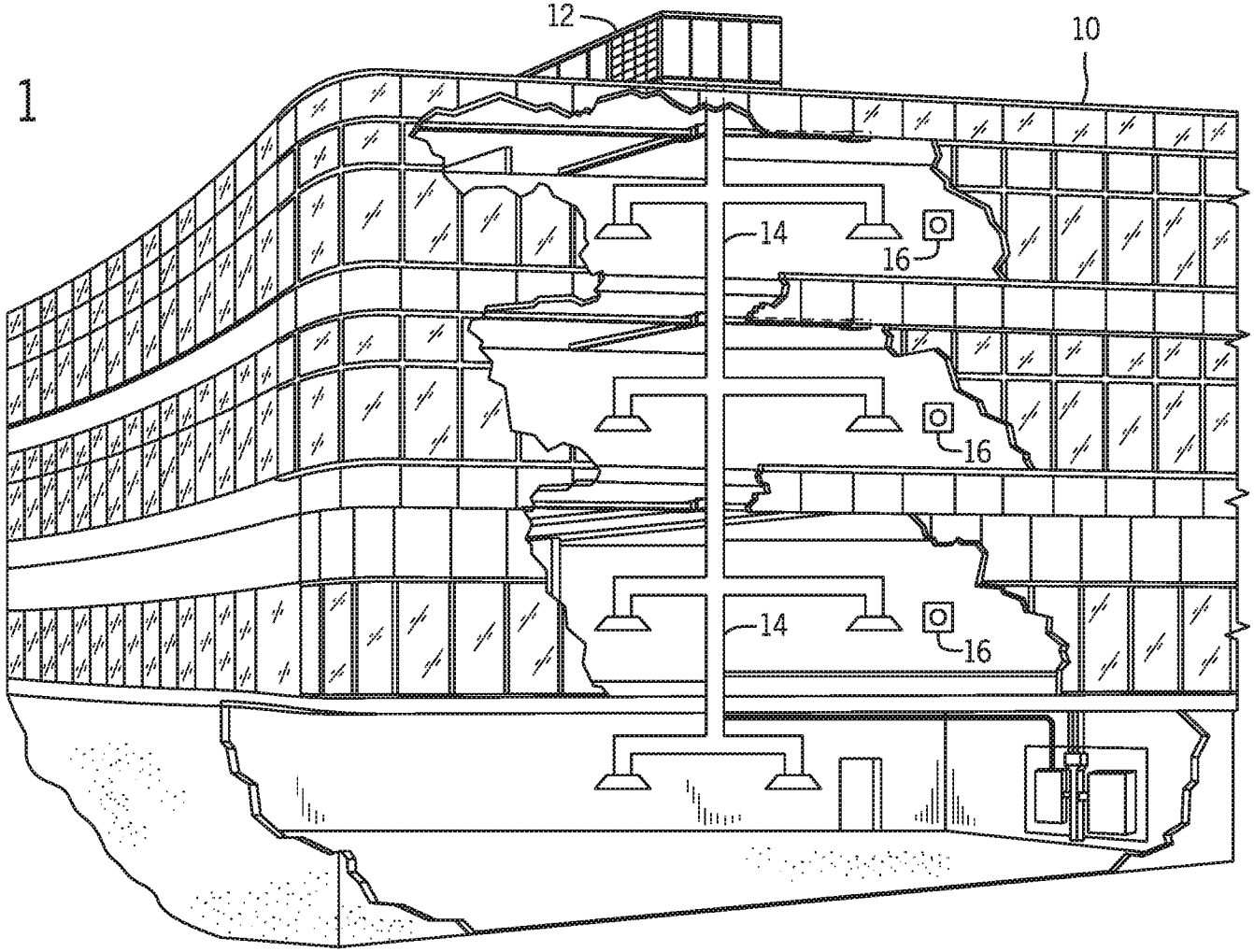
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements.

The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to an HVAC system configured to condition an air flow. For example, the HVAC system may use a vapor compression system that circulates a refrigerant and places the air flow in a heat exchange relationship with the refrigerant to condition the air flow. The HVAC system may include various enclosures or sections. Each enclosure may occupy a volume of space, and various equipment of the HVAC system may be disposed within the volume of space. The enclosure may also include a housing or cover, which may shield the components from external debris or elements.

In some circumstances, liquid may accumulate in one of the enclosures of the HVAC system. For instance, the HVAC system may include an enclosure that is positioned in an ambient environment, and precipitation may enter the enclosure. However, the accumulation of liquid in the enclosure may not be desirable. As an example, the liquid may travel within the enclosure undesirably, such as toward the equipment disposed within the enclosure and/or into a structure that is conditioned by the HVAC system. Furthermore, the liquid may affect a condition of the enclosure, such as by increasing a weight of the enclosure.

Thus, it is presently recognized that directing or guiding the liquid out of the enclosure may improve the operation of the HVAC system and/or the condition of the enclosure. Accordingly, embodiments of the present disclosure are directed to a sloped base pan that may be implemented with the enclosure. In an installed configuration, the sloped base pan may be downwardly sloped to direct liquid across the sloped base pan. Furthermore, the downward slope may extend from an interior of the enclosure to an outer edge of the enclosure, such that the sloped base pan directs the liquid toward the outer edge, off the sloped base pan and out of the enclosure. As such, the sloped base pan limits accumulation of liquid within the enclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
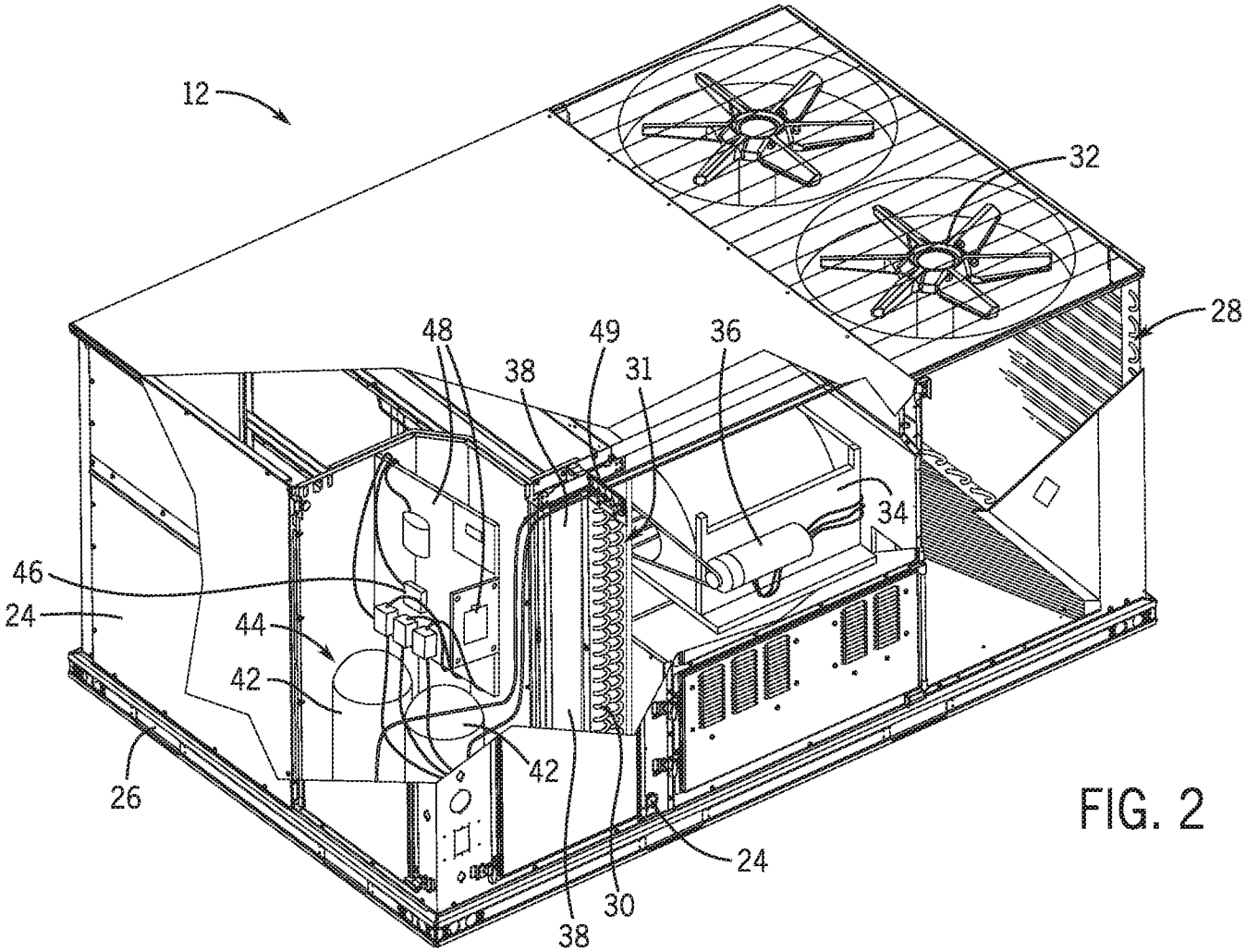
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
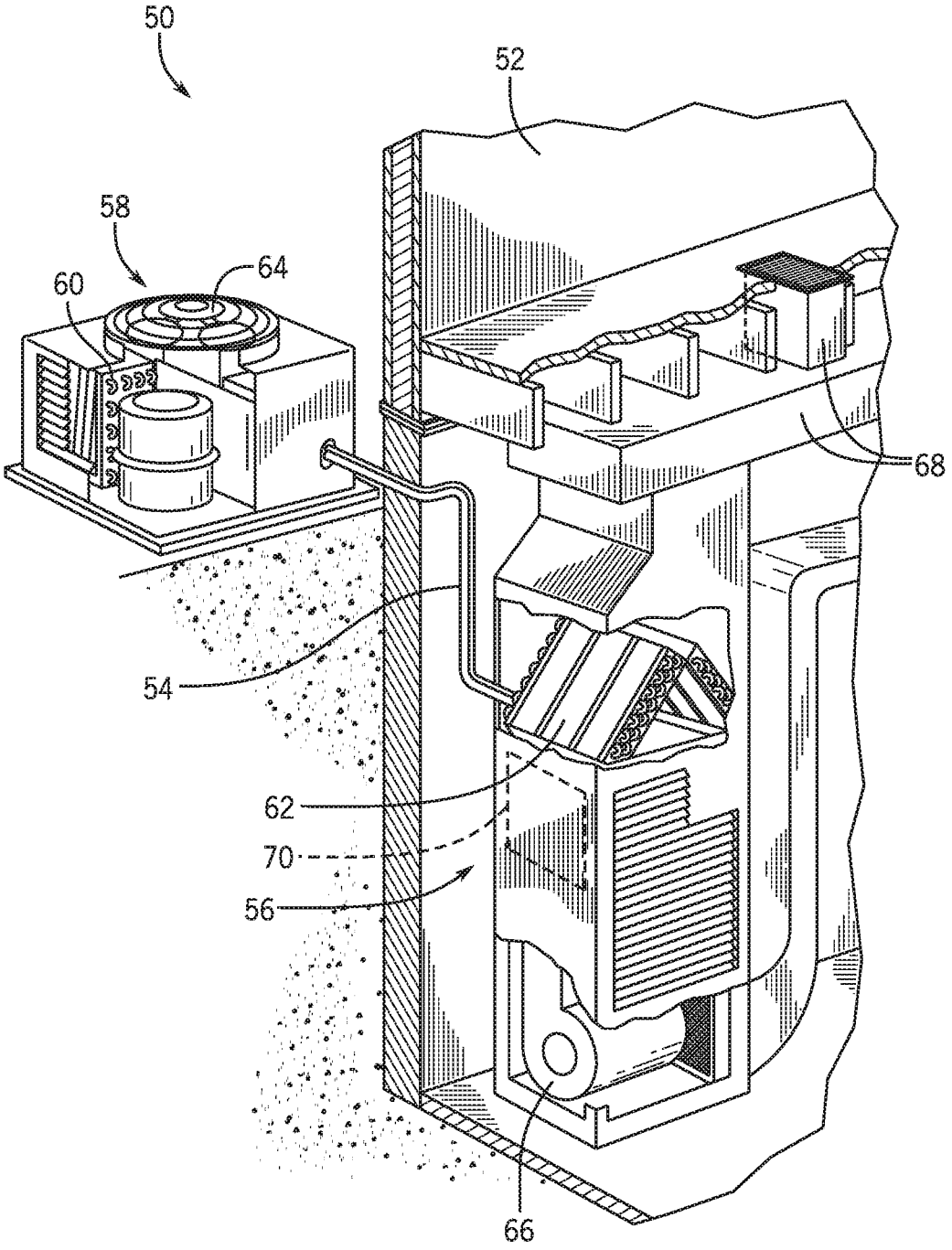
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
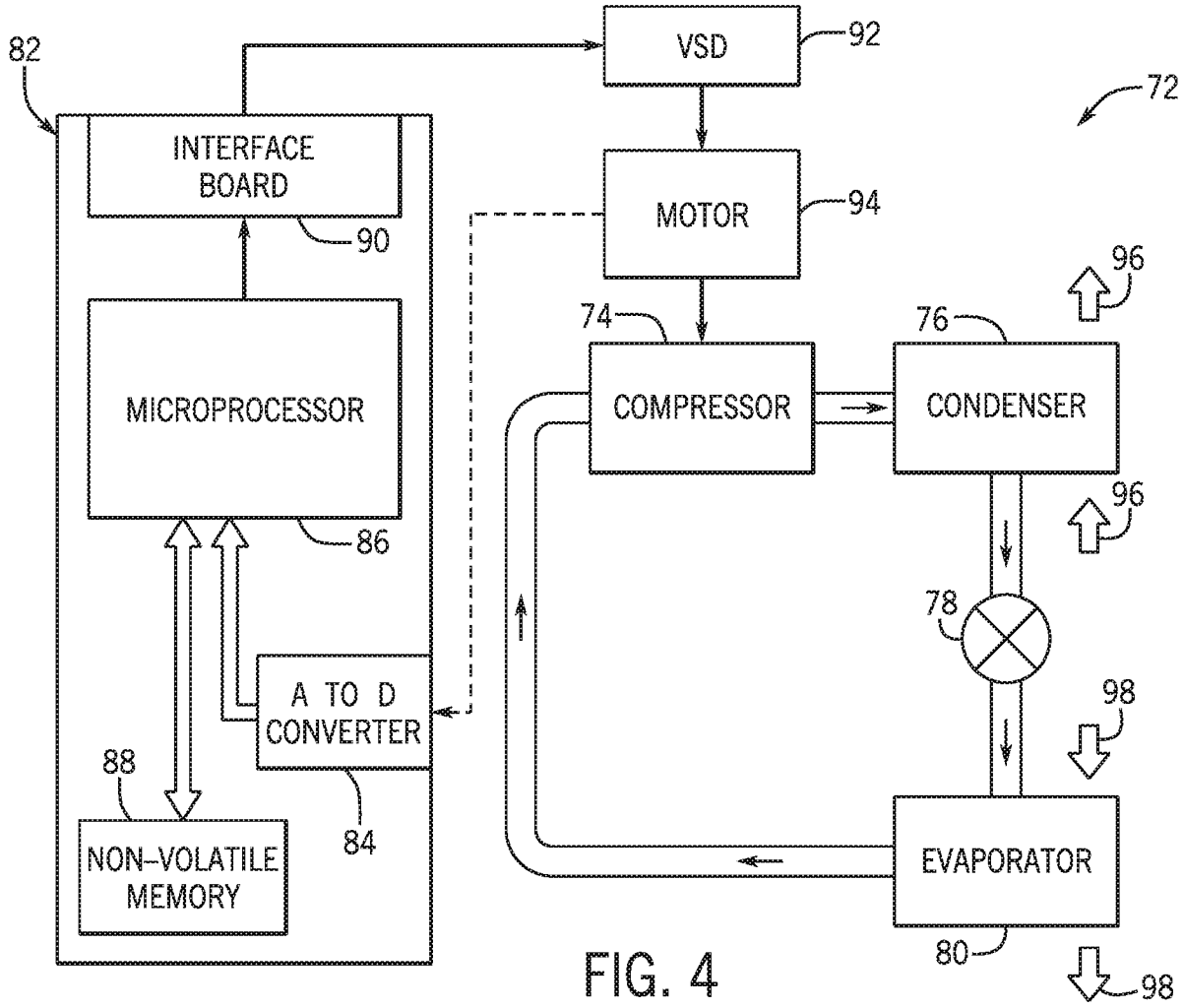
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a base pan that is installable within an enclosure of an HVAC system. The base pan may have a sloped profile that is configured to direct liquid out of the enclosure, thereby limiting accumulation of liquid within the enclosure. For example, the base pan may have a downward slope extending from an interior of the enclosure to an outer edge of the enclosure. Thus, liquid entering the enclosure and collecting on the base pan may flow across the base pan toward the outer edge to exit the enclosure. In some embodiments, the base pan may be configured to couple to another component within the enclosure. For instance, the base pan may have a first flange configured to capture and couple with a second flange of a compressor mounting base or other panel of the enclosure. Additionally or alternatively, the base pan may be configured to couple to a base rail of the enclosure, thereby securing the base pan within the enclosure. It should be noted that, although the present disclosure primarily discusses installation of the base pan within an outdoor enclosure, such as for a condensing section of the HVAC system, the base pan may be installed within any suitable enclosure of the HVAC system.

Figure 5:
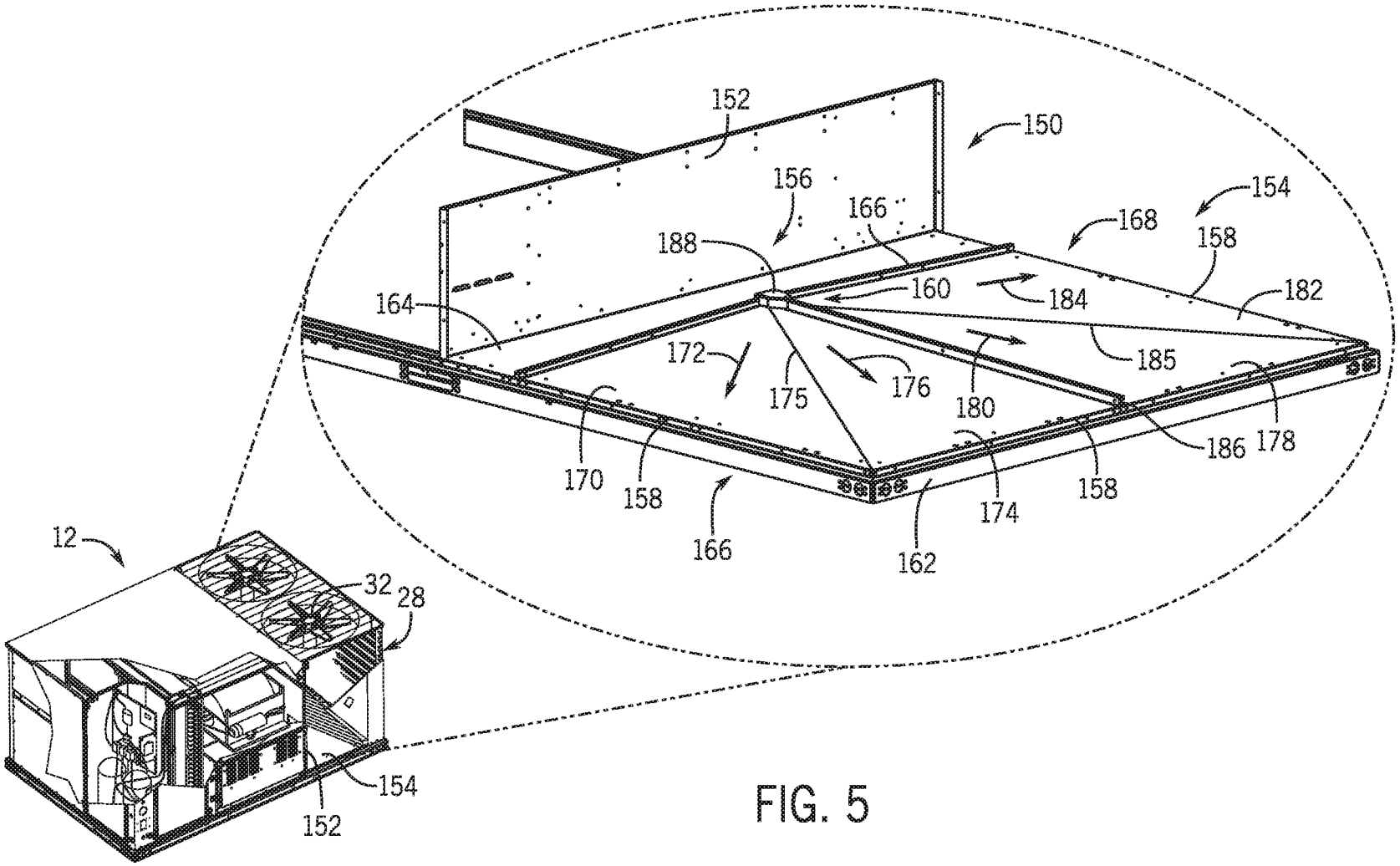
FIG. 5 is an expanded perspective view of an embodiment of an enclosure that may be employed within an HVAC unit, in accordance with an aspect of the present disclosure.

FIG. 5 is an expanded perspective view of an embodiment of an enclosure 150, such as an HVAC unit enclosure, which may be used to house, support, and/or enclose the heat exchanger 28 of the HVAC unit 12. However, the enclosure 150 may be used to enclose any suitable component of the HVAC unit 12 in additional or alternative embodiments. As used herein, the enclosure 150 may or may not include side panels, partitions, and so forth, to generally contain a volume of space. Certain components of the enclosure 150, such as the heat exchanger 28, the fans 32, and certain panels or partitions, have been removed for better visualization of an interior of the enclosure 150. The illustrated enclosure 150 includes a wall 152 that may separate the enclosure 150 from other sections of the HVAC unit 12, such as to block air from flowing between the enclosure 150 and the compartment 31. As such, the enclosure 150 may generally be isolated from a remainder of the HVAC unit 12. In some embodiments, the enclosure 150 may be an outdoor section of the HVAC unit 12, or a portion of the HVAC unit 12 positioned in an ambient environment. As a result, the enclosure 150 may be exposed to elements of the ambient environment, such as precipitation, that may cause liquid to enter into the enclosure 150. However, it may be undesirable for liquid to accumulate within the enclosure 150.

For this reason, the enclosure 150 may include a base pan 154, which may be formed from a smooth material, such as sheet metal, for directing liquid flow across the base pan 154. The base pan 154 may be sloped from an inner portion 156 of the enclosure 150 to an outer lateral edge 158 of the base pan 154. The slope of the base pan 154 may direct a flow of liquid on the base pan 154 within the enclosure 150 toward the lateral edge 158. In the illustrated embodiment, the base pan 154 has a generally rectangular geometry and may be configured to direct the flow of liquid to the outer lateral edge 158 in various directions. In additional or alternative embodiments, the base pan 154 may have any suitable geometry and may be configured to direct the flow of liquid to any suitable number of outer lateral edges 158. In any case, the base pan 154 may have an elevated surface, portion, or section 160 relative to the outer lateral edge 158, which may be generally positioned at a center of the inner portion 156 of the enclosure 150. The base pan 154 may downwardly extend from the elevated surface 160 to the outer lateral edge 158. As such, the base pan 154 may be downwardly sloped from the inner portion 156 toward the outer lateral edge 158 in multiple directions. For this reason, liquid on the base pan 154 may flow across the base pan 154 away from the elevated surface 160 and toward the outer lateral edge 158, where the liquid may exit the enclosure 150, such as by flowing over the outer lateral edge 158 and down a base 162, such as a base rail, of the enclosure 150. Thus, the base pan 154 may limit accumulation of liquid within the enclosure 150.

In one example, the base pan 154 may have a substantially linearly slope extending downwardly from the elevated surface 160. In another example, the base pan 154 may have a variable slope, such as a curved slope, extending downwardly from the elevated surface 160. In yet another example, the base pan 154 may have a step profile that extends downwardly from the elevated surface 160. In any case, the base pan 154 may generally extend downwardly from the elevated surface 160 in a continuous manner. That is, the base pan 154 may not have portions that are raised relative to the elevated surface 160.

In some embodiments, the enclosure 150 may contain a condenser of the HVAC unit 12. By way of example, the condenser may be mounted onto a portion of the base pan 154 and/or may be positioned above the base pan 154. In this manner, the base pan 154 may be a condenser base pan. Further, the base pan 154 may be positioned offset from the wall 152 of the enclosure 150. For example, the enclosure 150 may include a compressor base pan 164 positioned between the wall 152 and the base pan 154. The compressor base pan 164 may be configured to support a compressor. As an example, the compressor base pan 164 may have a generally flat surface onto which the compressor may mounted. Further, as will be described in greater detail below, the compressor base pan 164 may couple to the base pan 154 via a first interface 166. The first interface 166 may be configured to block liquid flow from the base pan 154 onto the compressor base pan 164, thereby blocking liquid flow toward the compressor. Further, the first interface 166 may be configured to block liquid from flowing through the enclosure 150 between the base pan 154 and the compressor base pan 164, thereby avoiding leakage through the enclosure 150.

In certain implementations, the base pan 154 may include multiple panels that are coupled to one another, such as proximate the inner portion 156. For instance, the base pan 154 may have a first panel 166 and a second panel 168. The first panel 166 may have a first surface 170 that generally slopes downward in a first direction 172 and extends from the elevated surface 160 to the outer lateral edge 158. The first panel 166 may also have a second surface 174 that generally slopes downward in a second direction 176 and extends from the elevated surface 160 to the outer lateral edge 158. The first panel 166 may further include a first bend or crease 175 extending between the first surface 170 and the second surface 174 and formed as a result of bending of the first panel 166. In other words, the first panel 166 may be bent to form the first surface 170 and the second surface 174, thereby forming the first bend 175 that divides the first surface 170 and the second surface 174. Similarly, the second panel 168 may have a third surface 178 that generally slopes downward in a third direction 180 and extends from the elevated surface 160 to the outer lateral edge 158. The second panel 168 may also have a fourth surface 182 that generally slopes downward in a fourth direction 184 and extends from the elevated surface 160 to the outer lateral edge 158. As such, the first panel 166 may be sloped from the elevated surface 160 to the outer lateral edge 158 in different directions than that of the second panel 168. Bending of the second panel 168 may also form a second bend 185 dividing the third surface 178 and the fourth surface 182.

The first panel 166 and the second panel 168 may be configured to couple to one another at the elevated surface 160 and along a second interface 186, which may extend generally along a center of the enclosure 150 in the illustrated embodiment between the second surface 174 and the third surface 178. Furthermore, the first panel 166 and the second panel 168 may form the elevated surface 160 in an installed configuration within the enclosure 150, and a bracket 188 may be used for securing the first panel 166 and the second panel 168 together, as well as for securing the first panel 166 and the second panel 168 to the compressor base pan 164. The second interface 186 may block liquid from flowing between the first panel 166 and the second panel 168. In this manner, the second interface 186 may also block liquid from flowing through the base pan 154 between the first panel 166 and the second panel 168, thereby avoiding leakage through the enclosure 150.

Figure 6:
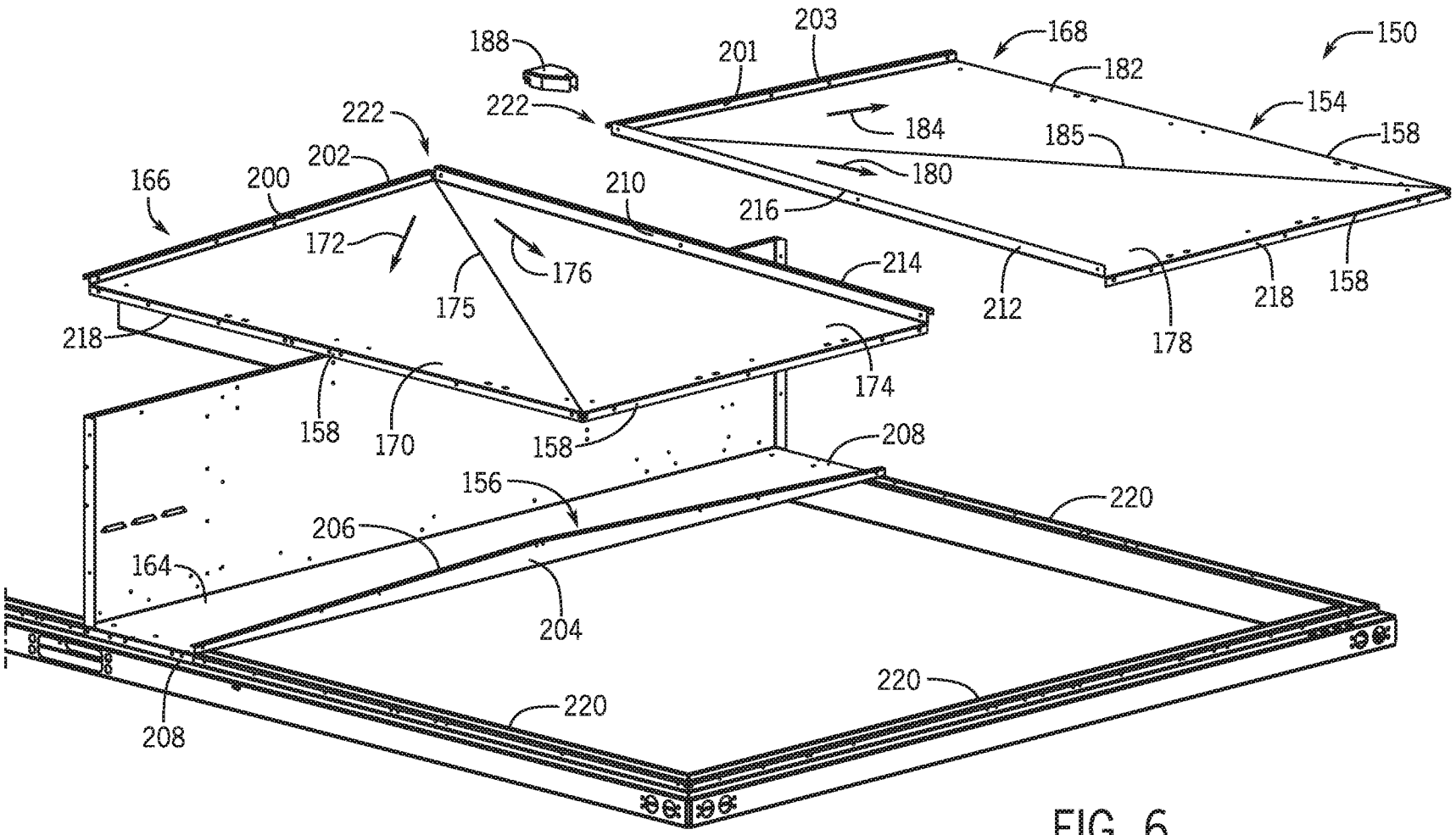
FIG. 6 is an exploded perspective view of an embodiment of an enclosure having a base pan with multiple panels, in accordance with an aspect of the present disclosure.

FIG. 6 is an exploded perspective view of an embodiment of the enclosure 150. The illustrated enclosure 150 includes the base pan 154 having the first panel 166 and the second panel 168. The first panel 166 may have a first side wall 200 and the second panel 168 may have a second side wall 201. For instance, the first side wall 200 of the first panel 166 may extend from the first surface 170, and the second side wall 201 of the second panel 168 may extend from the fourth surface 182. In addition, a first top flange 202 may extend from the first side wall 200, and a second top flange 203 may extend from the second side wall 201. The compressor base pan 164 may have a wall 204, such as a vertical wall, that has an upper flange 206 extending from the wall 204. The wall 204 may be configured to couple to the side walls 200, 201 of the first and second panels 166, 168. By way of example, the top flanges 202, 203 may capture the upper flange 206 of the compressor base pan 164 to couple the first panel 166 and the second panel 168 to the compressor base pan 164. Furthermore, mechanical fasteners may be used to secure the wall 204 to the side walls 200, 201, thereby securing the panels 166, 168 to the compressor base pan 164.

As shown in FIG. 6, the wall 204 may include a profile having a downward slope extending from the inner portion 156 of the enclosure 150 to an outer lateral edge 208 of the compressor base pan 164. As such, the upper flange 206 may also be sloped downwardly and away from the inner portion 156 of the enclosure 150 to the outer lateral edge 208 of the compressor base pan 164. For this reason, coupling the first side wall 200 of the first panel 166 to the wall 206 of the compressor base pan 164 may tilt the first surface 170 to extend in the first direction 172, and coupling the second side wall 201 of the second panel 168 to the wall 206 of the compressor base pan 164 may tilt the fourth surface 182 to extend in the fourth direction 184. Accordingly, the tilting of the first surface 170 and of the fourth surface 182 may enable liquid to flow across the panels 166, 168 in the directions 172, 184, respectively.

The first panel 166 may also include a third side wall 210 extending from the second surface 174, and the second panel 168 may include a fourth side wall 212 extending from the third surface 178. In the installed configuration, the third side wall 210 generally extends along the fourth side wall 212 to enable the third side wall 210 to couple to the fourth side wall 212. For instance, a third top flange 214 may extend transversely from the third side wall 210, and a fourth top flange 216 may extend transversely from the fourth side wall 212. In some embodiments, the third top flange 214 and the fourth top flange 216 may extend in substantially the same direction such that, in the installed configuration, the third top flange 214 may extend over and capture the fourth top flange 216. Mechanical fasteners may be used to couple the third top flange 214 to the fourth top flange 216, thereby coupling the second surface 174 and the third surface 178 together to couple the first panel 166 to the second panel 168 to one another.

Moreover, the outer lateral edges 158 each of the panels 166, 168 may have a respective flange 218. In the installed configuration, the flanges 218 may extend over base rails 220 extending along at least a portion of the perimeter of the enclosure 150. In this way, the panels 166, 168 may capture the base rails 220 in the installed configuration. Furthermore, fasteners may be used for securing the flanges 218 to the base rails 220, thereby securing the panels 166, 168 to the base rails 220 to secure the base pan 154 within the enclosure 150.

In the installed configuration, a seam 222 may be formed where the compressor base pan 164 and the panels 166, 168 join together. For example, the first side wall 200 may not be directly coupled to the third side wall 210 and, similarly, the second side wall 201 may not be directly coupled to the fourth side wall 212. As a result, respective gaps may be formed between the first side wall 200 and the third side wall 210 and between the second side wall 201 and the fourth side wall 212 at the inner portion 156. Therefore, the surfaces 170, 174, 178, 182 may downwardly slope away from the seam 222 to block liquid flow through the seam 222 and through the base pan 154. Furthermore, the bracket 188 may be implemented to block liquid flow through the formed gaps and further block liquid flow through the seam 222. For instance, the bracket 188 may capture the third side wall 210 and the fourth side wall 212, and the bracket 188 may also capture the first side wall 200, the second side wall 201, and the wall 204 of the compressor base pan 164.

In the illustrated embodiment, the panels 166, 168 have approximately identical or symmetrical profiles. As an example, the panels 166, 168 may have substantially similar shapes, sizes, slopes, bends, and so forth. In additional or alternative embodiments, the panels 166, 168 may be different than one another. As another example, one of the panels may have a rectangular shape and another panel may have a triangular shape.

Figure 7:
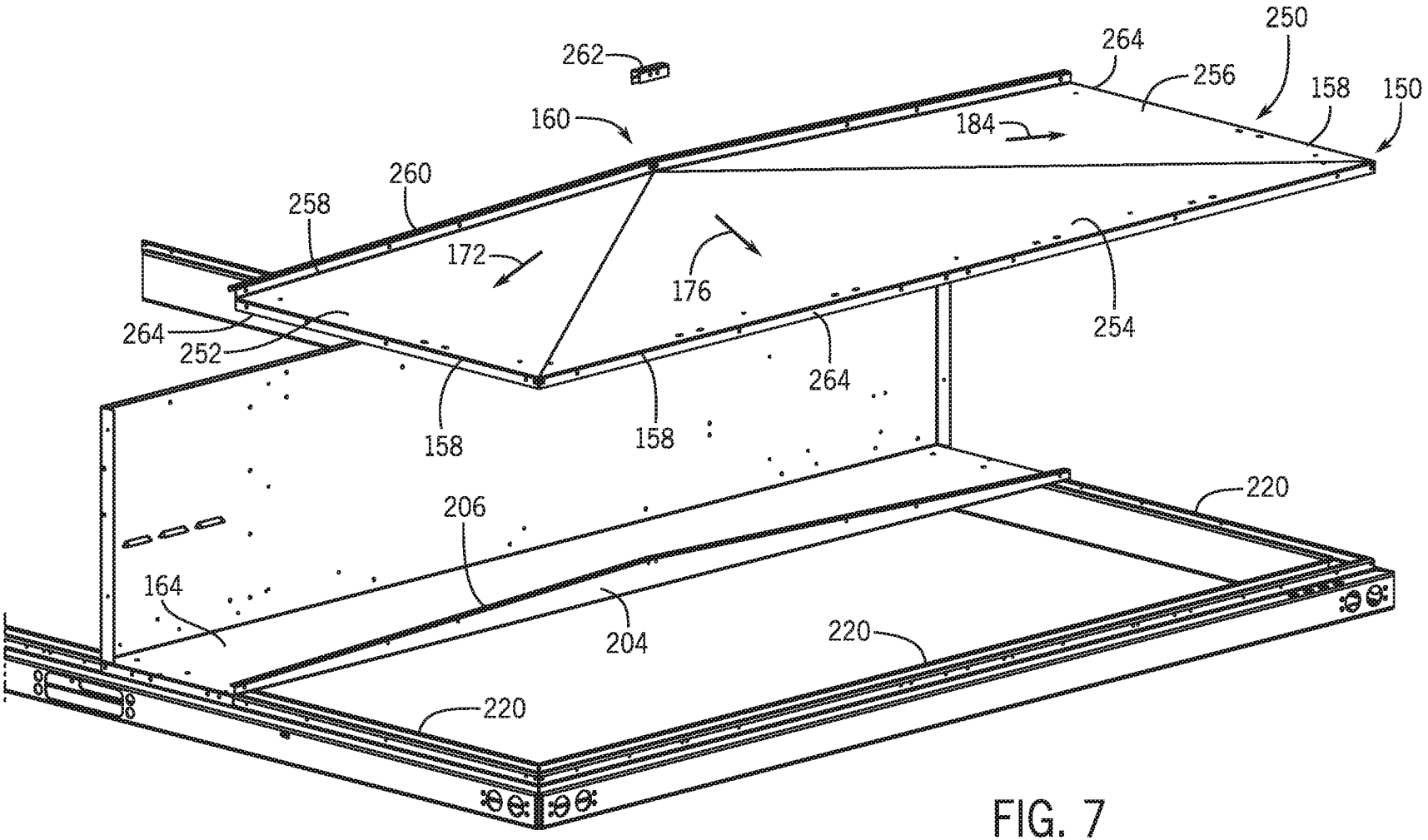
FIG. 7 is an exploded perspective view of an embodiment of an enclosure having a base pan with a single panel, in accordance with an aspect of the present disclosure.

FIG. 7 is an exploded perspective view of an embodiment of the enclosure 150 having a base pan 250. The base pan 250 of the illustrated embodiment includes a single panel, rather than multiple panels. For example, the base pan 250 may have a profile forming the elevated surface 160, and the base pan 250 may include a first surface 252 generally sloped downwardly from the elevated surface 160 in the first direction 172, a second surface 254 generally sloped downwardly from the elevated surface 160 in the second direction 174, and a third surface 256 generally sloped downwardly from the elevated surface 160 in the third direction 184. In this manner, the base pan 250 may also direct liquid flow away from the elevated surface 160 in multiple directions toward the outer lateral edge 158.

The base pan 250 may have a side wall 258 that extends along the first surface 252, the second surface 254, the third surface 256, or any combination thereof. Further, a top flange 260 may extend from the side wall 258. The profile of the top flange 260 may match the profile of the wall 204 such that, in the installed configuration, the top flange 260 may capture the upper flange 206 of the wall 204 of the compressor base pan 164, thereby coupling the base pan 250 and the compressor base pan 164 together. In some implementations, a bracket 262 may be used to further secure the base pan 250 and the compressor base pan 164 together. For instance, the bracket 262 may be used to fasten the side wall 258 and the wall 204 to one another. Further still, the base pan 250 may have flanges 264 that are configured to engage the base rails 220 of the enclosure 150 in the installed configuration, thereby coupling the base pan 250 to the base rails 220.

Although FIGS. 5 and 6 illustrate the base pan 154 as having two panels 166, 168 and FIG. 7 illustrates the base pan 250 as having a single panel, other embodiments of base pans may have any suitable number of panels. Indeed, additional or alternative embodiments of base pans may have three panels, four panels, five or more panels, or any suitable number of panels that are sloped to direct a flow of liquid out of the enclosure 150.

Figure 8:
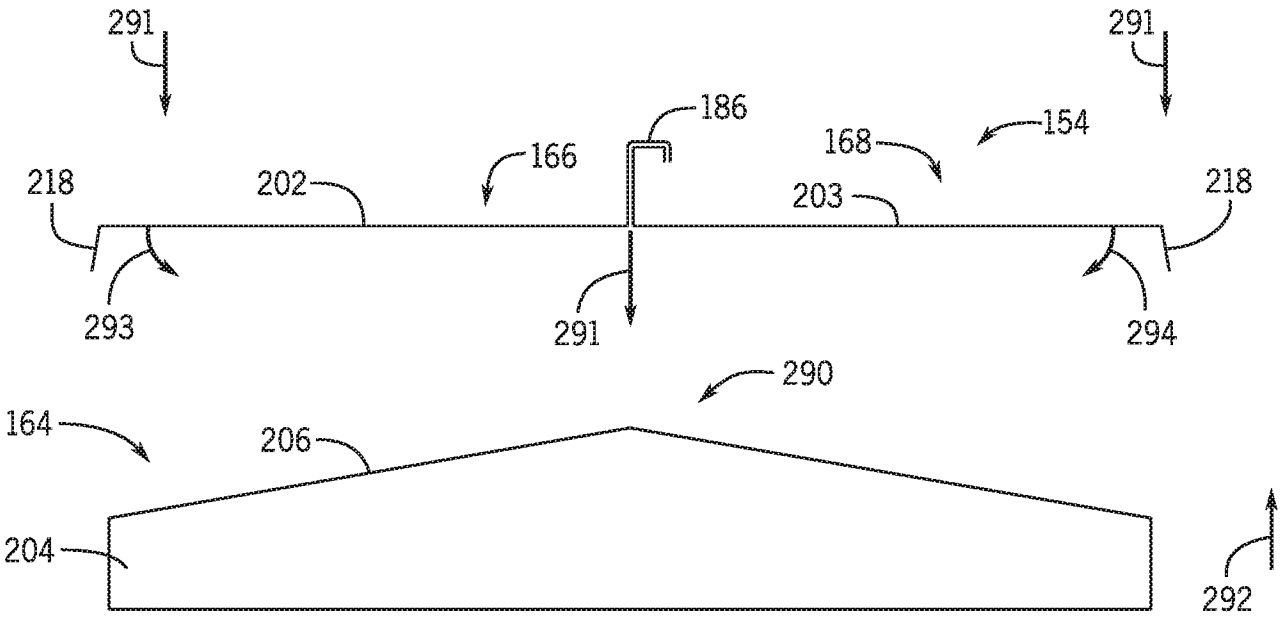
FIG. 8 is a exploded front view of an embodiment of a base pan of an HVAC unit, in accordance with an aspect of the present disclosure.

FIG. 8 is an exploded front view of an embodiment of the base pan 154 having the panels 166, 168 configured to couple to the wall 204 of the compressor base pan 164. In some embodiments, the sloped profile of the panels 166, 168 may be formed by engaging the panels 166, 168 with the compressor base pan 164. For example, the wall 204 may have an apex 290, and the base pan 154 may be moved in a direction 291 along a vertical axis 292 to engage the wall 204 such that the apex 290 imparts a force that bends the base pan 154. For instance, when the apex 290 is in contact with the base pan 154, generally downward forces may be applied to the first panel 166 and to the second panel 168 to bend the base pan 154. The applied forces may cause the first panel 166 to bend or rotate in a first rotational direction 293 so as to couple the first top flange 202 to the upper flange 206 of the wall 204. Additionally, the applied forces may cause the second panel 168 to bend or rotate in a second rotational direction 294 to couple the second top flange 203 to the upper flange 206. As such, the apex 290 may bend the panels 166, 168 to tilt the first surface 170 and the fourth surface 182. In the illustrated embodiment, the apex 290 is positioned approximately center to the base pan 154, such as aligned with the second interface 186 about the vertical axis 292. However, in additional or alternative embodiments, the apex 290 may be offset with respect to a center of the base pan 154, such as for embodiments of the base pan 154 having differently shaped panels 166, 168.

Figure 9:
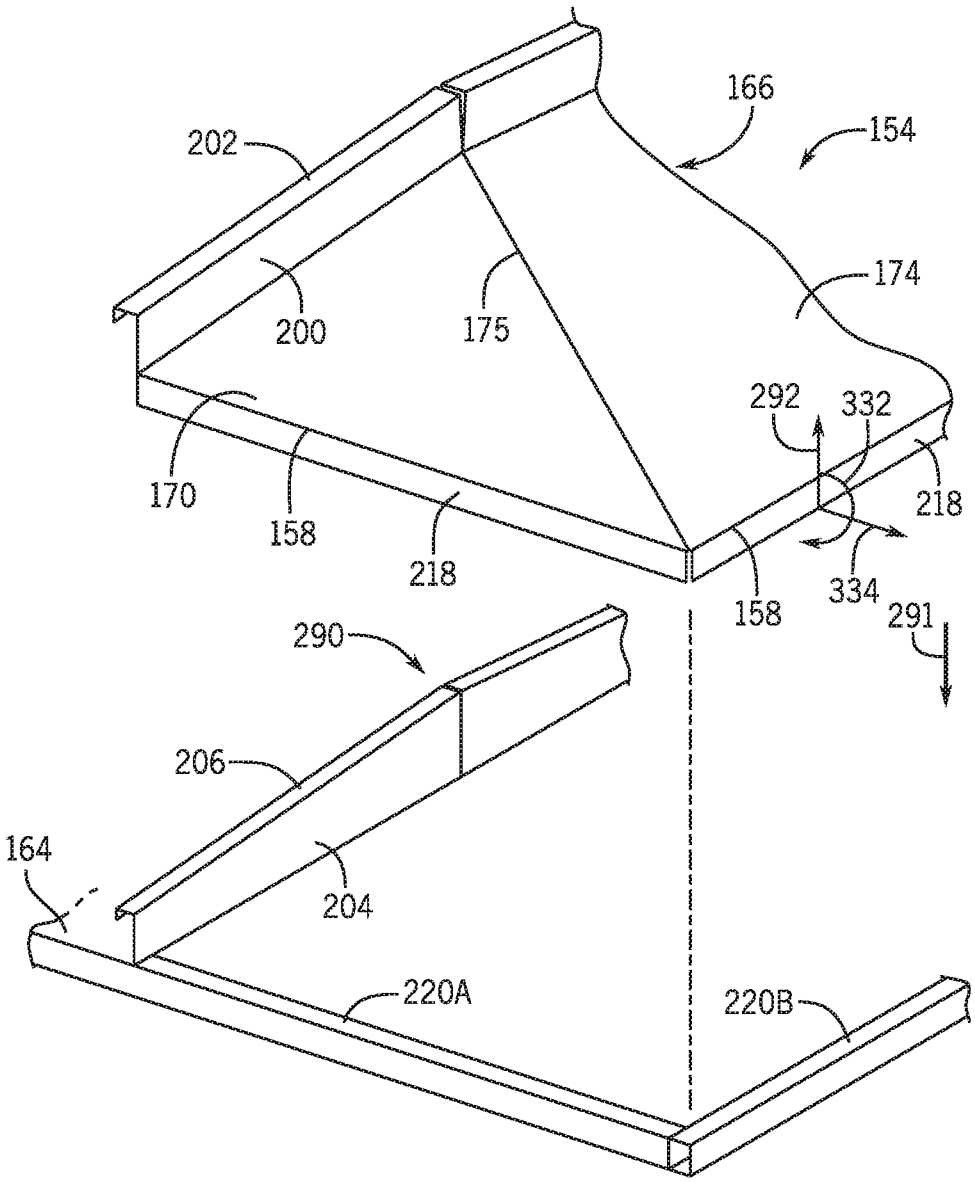
FIG. 9 is a partial exploded perspective view of an embodiment of a base pan of an HVAC unit, in accordance with an aspect of the present disclosure.

FIG. 9 is a partial exploded perspective view of an embodiment of the base pan 154 configured to couple to the wall 204 of the compressor base pan 164 and to the base rails 220. FIG. 9 is described with respect to the first panel 166, but the details described herein may also similarly apply to the second panel 168. In the illustrated embodiment, the first side wall 200 and the first top flange 202 are bent to align with the upper flange 206 of the wall 204, such as by using the techniques described with respect to FIG. 8. Thus, the base pan 154 is formed to couple the first panel 166 with the compressor base pan 164. Forming the base pan 154 to couple the first panel 166 to the compressor base pan 164 may also enable the flange 218 of the first surface 170 to align with and/or capture a first base rail 220A. In other words, biasing the first panel 166 against the wall 204, which is sloped in the manner described above, and bending the first panel 166 such that the flange 218 may couple to the first base rail 220A may form the sloped profile of the base pan 154. However, such forming of the base pan 154 may not enable the flange 218 to readily couple with a second base rail 220B, which extends transversely with respect to the first base rail 220A in the illustrated embodiment. That is, the flange 218 of the second surface 174 may not align with the second base rail 220B using the techniques described with respect to FIG. 8.

For this reason, a force may be applied to the second surface 174 in a downward direction 291 relative to the vertical axis 292 to urge the flange 218 of the second surface 174 to engage with the second base rail 220B. By way of example, the force may cause the flange 218 of the second surface 174 to bend in a third rotational direction 332 about a lateral axis 334. In this way, the second surface 174 may also be bent relative to the first surface 170, thereby forming the first bend 175. Upon bending the second surface 174, the flange 218 may engage with the second base rail 220B, and the base pan 154 may be coupled to the second base rail 220B, such as via mechanical fasteners inserted through the flange 218 and the second base rail 220B.

In additional or alternative embodiments, the profile of the base pan 154 may be pre-formed. That is, rather than bending the base pan 154 by using the wall 204, the base pan 154 may be shaped prior to installation within the enclosure 150. As such, the shape of the base pan 154 may enable the base pan 154 to readily couple to the wall 204 and to the base rails 220 without having to reshape the base pan 154.

Figure 10:
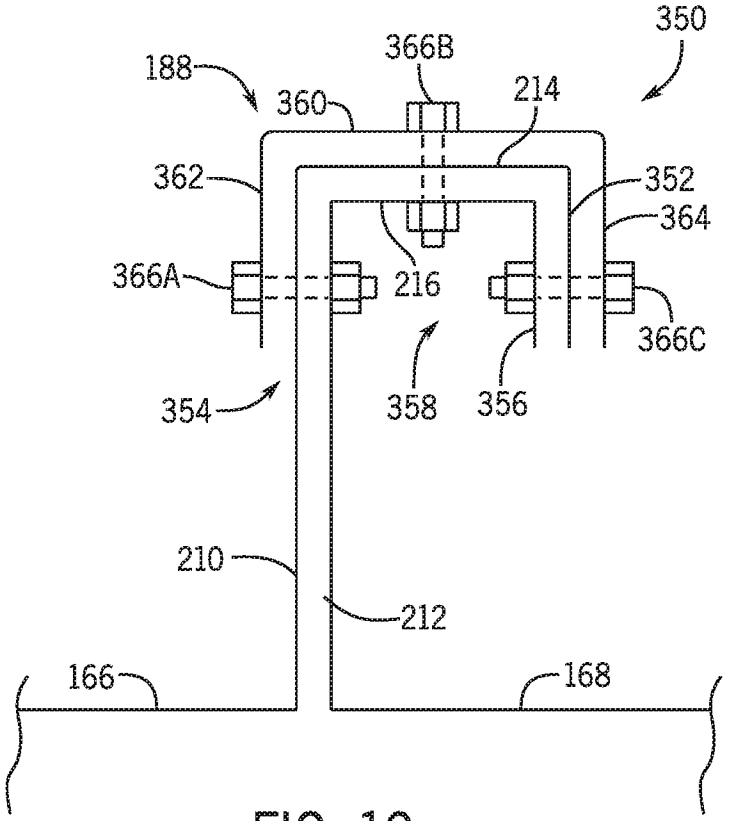
FIG. 10 is an expanded side view of an embodiment of an interface of a base pan coupled to an HVAC unit, in accordance with an aspect of the present disclosure.

FIG. 10 is an expanded view of an embodiment of an interface 350 between components of the base pan 154 coupled to one another in an installed configuration. In the illustrated embodiment, the interface 350 is implemented as the second interface 186, at which the first panel 166 and the second panel 168 are coupled to one another, but in additional or alternative embodiments, the interface 350 may be implemented as the first interface 166, at which the base pan 154 and the compressor base pan 164 are coupled to one another. As shown in FIG. 10, the third side wall 210, the third top flange 214, and a first side flange 352 extending transversely from the third top flange 214 may form a first extension 354 of the first panel 210 having a hook-shaped profile. Similarly, the fourth side wall 212, the fourth top flange 216, and a second side flange 356 extending transversely from the fourth top flange 216 may form a second extension 358 of the second panel 212 also having a hook-shaped profile. In the illustrated interface 350, the first extension 354 and the second extension 358 may be facing in substantially the same direction. As such, the first extension 354 may capture the second extension 358 in the installed configuration. For instance, the third side wall 210 and the fourth side wall 212 may abut one another, the third top flange 214 may extend over and abut the fourth top flange 216, and the first side flange 352 may extend over and abut the second side flange 356.

In addition, the bracket 188 may be disposed over the first extension 354 and the second extension 358. By way of example, the bracket 188 may include a top segment 360 configured to abut the third top flange 214 of the first extension 354. Furthermore, the bracket 188 may include a first side segment 362 extending transversely from the top segment 360 and which may abut the third side wall 210 of the first extension 354. The bracket 188 may also include a second side segment 364 extending transversely from the top segment 360 opposite the first side segment 362. The second side segment 364 may similarly abut the first side flange 352 of the first extension 354. In this way, the bracket 188 may straddle and capture the first extension 354 in the interface 350.

In certain implementations, mechanical fasteners 366 may also be used to couple the panels 166, 168 and the bracket 188 together. By way of example, a first set of mechanical fasteners 366A may extend through the first side segment 362, the third side wall 210, and the second side wall 212 to secure the panels 166, 168 and the bracket 188 to one another. Additionally or alternatively, a second set of mechanical fasteners 366B may extend through the top segment 360, the third top flange 214, and the fourth top flange 216, further securing the panels 166, 168 and the bracket 188 to one another. In further embodiments, a third set of mechanical fasteners 366C may extend through the second side segment 364, the first side flange 352, and the second side flange 356 to secure the panels 166, 168 and the bracket 188 to one another. Although the mechanical fasteners 366 include a bolt and a screw in the illustrated embodiment, additional or alternative embodiments may use a different type of mechanical fastener, such as a rivet or a clamp. In further embodiments, the features of the panels 166, 168 and the bracket 188 may be coupled in another suitable manner, such as via a weld, an adhesive, a punch, or any combination thereof. In any case, the features of the panels 166, 168 and the bracket 188 may be coupled together to restrict movement between the panels 166, 168 and the bracket 188, thereby securing the base pan 154 within the enclosure 150.

Figure 11:
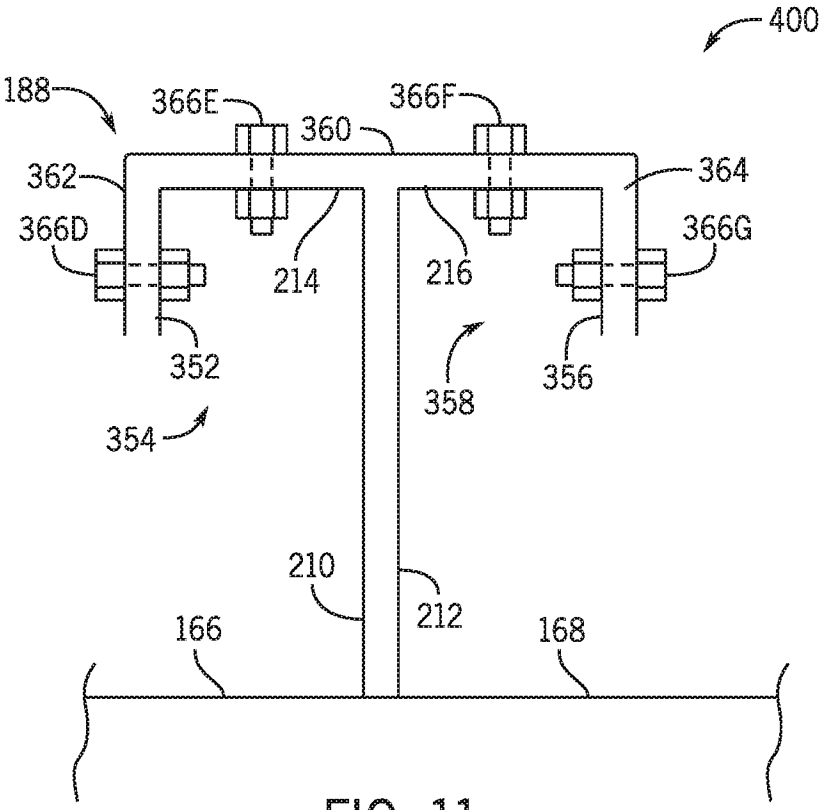
FIG. 11 is an expanded side view of another embodiment of an interface of a base pan coupled to an HVAC unit, in accordance with an aspect of the present disclosure.

FIG. 11 is an expanded view of an embodiment of an interface 400 between components of the base pan 154 coupled to one another in an installed configuration. Similar to the interface 350, the interface 400 is implemented as the second interface 186 to couple the first panel 166 to the second panel 168 in the illustrated embodiment, but in additional or alternative embodiments, the interface 400 may be implemented as the first interface 166 to couple the base pan 154 to the compressor base pan 164. In the illustrated interface 400, the hook-shaped profile of the first extension 354 and the hook-shaped profile of the second extension 358 face opposite directions. In this way, the first extension 354 and the second extension 358 do not capture one another. Instead, the bracket 188 may be used to couple the panels 166, 168 together. By way of example, the third side wall 210 may abut the fourth side wall 212 in the interface 400, and the third top flange 214 may be substantially leveled or aligned with the fourth top flange 216. Further, the top segment 360 may be positioned to abut the third top flange 214 and the fourth top flange 216 in the installed configuration. Additionally, the first side segment 362 of the bracket 188 may abut the first side flange 352 of the first extension 354, and the second side segment 364 of the bracket 188 may abut the second side flange 356 of the second extension 358 in the interface 400. In this manner, the bracket 188 may straddle and capture both the first panel 166 and the second panel 168 together.

The mechanical fasteners 366 may also be used for securing the panels 166, 168 and the bracket 188 to one another. By way of example, a fourth set of mechanical fasteners 366D may secure the first side segment 362 and the first side flange 352 to one another, a fifth set of mechanical fasteners 366E may secure the top segment 360 and the third top flange 214 to one another, a sixth set of mechanical fasteners 366F may secure the top segment 360 and the fourth top flange 216 to one another, and/or a seventh set of mechanical fasteners 366G may secure the second side segment 364 and the second side flange 356 to one another. As such, the mechanical fasteners 366 may be used to restrict movement between the panels 166, 168 and the bracket 188, thereby securing the base pan 154 in the enclosure 350.

The present disclosure may provide one or more technical effects useful in the operation of an HVAC system. For example, a base pan may be implemented within an enclosure of the HVAC system. In some embodiments, the base pan may include multiple panels that are configured to couple to one another. In additional or alternative embodiments, the base pan may have a single panel. Furthermore, in certain embodiments, the base pan may be configured to couple to a compressor base pan positioned in the enclosure to secure the base pan within the enclosure. The base pan may be sloped downwardly from an inner portion of the enclosure to an outer lateral edge of the base pan such that the base pan is configured to direct liquid toward the outer lateral edge. That is, the base pan may form an elevated surface in the enclosure, and remaining surfaces of the base pan may extend downwardly from the elevated surface toward the outer lateral edge. In this way, liquid may flow across the base pan away from the elevated surface, and the base pan limits accumulation of liquid within the enclosure. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

an HVAC unit enclosure;

a first base pan of the HVAC unit enclosure, wherein the first base pan comprises an outer lateral edge, and the first base pan is sloped from an inner portion of the HVAC unit enclosure to the outer lateral edge on a first side of the first base pan and to the outer lateral edge on a second side, different from the first side, of the first base pan, such that the first base pan is configured to direct flow of liquid to flow off the outer lateral edge on the first side of the first base pan and off the outer lateral edge on the second side of the first base pan; and a second base pan of the HVAC unit enclosure, wherein the first base pan and the second base pan abut one another.

2. The HVAC unit of claim 1, wherein the HVAC unit enclosure includes an outdoor condenser, the first base pan is a condenser base pan, the second base pan is a compressor base pan, the compressor base pan includes a vertical wall having an upper flange, and the upper flange is sloped downwardly away from the inner portion of the HVAC unit enclosure toward the outer lateral edge on the first side of the condenser base pan.

3. The HVAC unit of claim 2, wherein the condenser base pan includes a side wall and a top flange extending from the side wall, and the top flange of the condenser base pan abuts and captures the upper flange of the compressor base pan to engage the condenser base pan and the compressor base pan with one another.

4. The HVAC unit of claim 1, comprising a base rail extending along a portion of a perimeter of the HVAC unit enclosure, wherein the outer lateral edge of the first base pan includes a flange coupled to the base rail.

5. The HVAC unit of claim 1, wherein the first base pan comprises a first panel sloped from the inner portion of the HVAC unit enclosure to the first side of the first base pan, and the first base pan comprises a second panel sloped from the inner portion to the second side of the first base pan.

6. The HVAC unit of claim 5, wherein the first panel and the second panel are coupled to one another at the inner portion of the HVAC unit enclosure.

7. The HVAC unit of claim 6, wherein the first panel includes a first side wall and a first top flange extending from the first side wall, the second panel includes a second side wall and a second top flange extending from the second side wall, and the first top flange extends over the second top flange.

8. The HVAC unit of claim 7, comprising a mechanical fastener extending through the first side wall and the second side wall to secure the first side wall and the second side wall to one another.

9. The HVAC unit of claim 1, wherein the first base pan is sloped downwardly from a seam formed within the inner portion of the HVAC unit enclosure.

10. The HVAC unit of claim 1, wherein the first base pan forms an elevated surface within the inner portion and relative to the outer lateral edge.

11. The HVAC unit of claim 10, wherein the first base pan extends continuously downwardly from the elevated surface to the first side of the first base pan.

12. A heating, ventilation, and/or air conditioning (HVAC) unit, comprising:

a condenser;

a first base pan positioned beneath the condenser, wherein the first base pan includes an outer lateral edge, an elevated surface relative to the outer lateral edge, and a surface extending from the elevated surface to the outer lateral edge, the first base pan is positioned in an enclosure of the HVAC unit, and the first base pan is downwardly sloped from the elevated surface to the outer lateral edge such that the first base pan is configured to direct liquid away from the elevated surface to the outer lateral edge; and a second base pan positioned beneath a compressor of the HVAC unit and in the enclosure of the HVAC unit, wherein the second base pan abuts the first base pan in the enclosure of the HVAC unit.

13. The HVAC unit of claim 12, wherein the first base pan includes a top flange, and the top flange directly contacts and captures an upper flange of the second base pan in the enclosure to couple the first base pan to the second base pan.

14. The HVAC unit of claim 12, wherein the first base pan includes a flange coupled to a base rail extending around at least a portion of a perimeter of the enclosure.

15. The HVAC unit of claim 12, wherein the first base pan is downwardly sloped from the elevated surface to the outer lateral edge in a plurality of directions.

16. The HVAC unit of claim 15, wherein the surface is a first surface extending from the elevated surface to the outer lateral edge in a first direction, and the first base pan includes a second surface extending from the elevated surface to the outer lateral edge in a second direction, and the first base pan includes a bend formed between the first surface and the second surface.

17. A heating, ventilation, and/or air conditioning (HVAC) unit, comprising:

an enclosure; and a base pan disposed within the enclosure, wherein the base pan includes an outer lateral edge, a first panel sloped from an inner portion of the enclosure to a first portion of the outer lateral edge extending along a first side of the base pan, a second panel sloped from the inner portion of the enclosure to a second portion of the outer lateral edge extending along a second side of the base pan, opposite the first side, wherein the first panel and the second panel are sloped away from one another from the inner portion to the first portion of the outer lateral edge and to the second portion of the outer lateral edge, respectively, the first panel is configured to direct liquid from the inner portion to the first portion of the outer lateral edge, and the second panel is configured to direct liquid from the inner portion to the second portion of the outer lateral edge.

18. The HVAC unit of claim 17, wherein the first panel includes a first extension having a first hook-shaped profile, and the second panel includes a second extension having a second hook-shaped profile.

19. The HVAC unit of claim 18, wherein the first extension extends over the second extension to couple the first panel and the second panel to one another, and the base pan includes a bracket disposed over the first extension and a plurality of fasteners extending through the bracket, the first extension, and the second extension to secure the first panel and the second panel to one another.

20. The HVAC unit of claim 18, wherein the first hook-shaped profile of the first extension and the second hook-shaped profile of the second extension face opposite directions, the base pan includes a bracket disposed over the first extension and the second extension, and the HVAC unit comprises a first fastener extending through the bracket and the first extension and a second fastener extending through the bracket and the second extension to secure the first panel and the second panel to one another.

21. The HVAC unit of claim 17, comprising a compressor base pan disposed in the enclosure, wherein the compressor base pan includes a wall and an upper flange extending from the wall, the first panel includes a first side wall and a first top flange extending transversely from the first side wall and over the upper flange to capture the upper flange and couple the first panel to the compressor base pan, and the second panel includes a second side wall and a second top flange extending transversely from the second side wall and over the upper flange to capture the upper flange and couple the second panel to the compressor base pan.

22. The HVAC unit of claim 21, comprising a bracket disposed over the first panel, the second panel, and the compressor base pan to secure the first panel, the second panel, and the compressor base pan to one another.

23. The HVAC unit of claim 17, wherein the enclosure includes a base rail extending along a portion of a perimeter of the enclosure, the first panel and the second panel each include a flange, and each flange is configured to engage the base rail to couple the first panel and the second panel to the base rail.

* * * * *